US008844452B2

(12) United States Patent
Savoldi

(10) Patent No.: US 8,844,452 B2
(45) Date of Patent: Sep. 30, 2014

(54) MACHINE FOR EMBROIDERING AN ITEM

(75) Inventor: Silverio Savoldi, Gavardo (IT)

(73) Assignee: Savmik S.R.L., Gavardo (IT)

( * ) Notice: Subject to any disclaimer, the term of this patent is extended or adjusted under 35 U.S.C. 154(b) by 52 days.

(21) Appl. No.: 13/639,676

(22) PCT Filed: Apr. 5, 2011

(86) PCT No.: PCT/IB2011/051458

§ 371 (c)(1),
(2), (4) Date: Dec. 11, 2012

(87) PCT Pub. No.: WO2011/125021

PCT Pub. Date: Oct. 13, 2011

(65) Prior Publication Data

US 2013/0199428 A1 Aug. 8, 2013

(30) Foreign Application Priority Data

Apr. 9, 2010 (IT) ..... BS2010A0067

(51) Int. Cl.

| | |
|---|---|
| ***D05C 7/04*** | (2006.01) |
| ***D05B 21/00*** | (2006.01) |
| ***D05C 9/06*** | (2006.01) |
| ***D05C 9/04*** | (2006.01) |
| ***D05C 7/02*** | (2006.01) |

(52) U.S. Cl.

CPC ..... *D05C 7/02* (2013.01); *D10B 2501/042* (2013.01); *D05B 21/007* (2013.01); *D05C 9/06* (2013.01); *D05C 9/04* (2013.01)

USPC ..... 112/103

(58) Field of Classification Search

USPC ..... 112/103, 104, 114, 115, 475.11, 112/470.13, 470.14, 470.17, 470.18

See application file for complete search history.

(56) References Cited

U.S. PATENT DOCUMENTS

| | | | | |
|---|---|---|---|---|
| 4,665,844 | A | 5/1987 | Shibata | |
| 4,998,964 | A | 3/1991 | Golia | |
| 5,553,560 | A | 9/1996 | Tajima et al. | |
| 6,065,413 | A | 5/2000 | Kawaguchi | |
| 6,463,867 | B2 * | 10/2002 | Kato | 112/103 |
| 6,782,836 | B1 | 8/2004 | Hales | |
| 7,080,602 | B2 * | 7/2006 | Kawaguchi et al. | 112/103 |
| 7,100,523 | B2 * | 9/2006 | Terao | 112/103 |

* cited by examiner

*Primary Examiner* — Tejash Patel
(74) *Attorney, Agent, or Firm* — Pearne & Gordon LLP

(57) ABSTRACT

Machine (1) for embroidering a hat comprising a frame (5), a head (10) mounted to the frame and provided with upper embroidering members (15), a vertical column (25) having a lower end (26) fastened to the frame and a free upper end (27) provided with lower embroidering members, and a positioning device (50) comprising a support (70), removably housing the hat, and members (60) for moving the support with respect to the frame so as to make an embroidery on the hat, the positioning device being structured so that the support rotates around a first axis (I), orthogonal to an axis of development of the vertical column, and around a second axis (II), orthogonal to the first axis and to the axis of development, and intersecting the first axis in a center of rotation (C) vertically aligned with, and at a lower level than, a point in space (P).

10 Claims, 3 Drawing Sheets

MACHINE FOR EMBROIDERING AN ITEM

The present invention relates to a machine for embroidering an item, in particular for items having at least a substantially spherical surface portion. In further detail, the invention relates to a machine for embroidering textile items, such as e.g. hats, caps or headgears in general.

It is known about embroidery machines that are able to make an embroidery on the surface of textile items, such as e.g. clothing, or other products, e.g. a bag. These machines have a fixed head provided with one or more needles and located above a fixed horizontal arm having on its end the members (typically a crochet and a bobbin) required for forming the embroidery stitch, e.g. a knotted stitch. The item to be embroidered is fastened to a mobile frame, so that the surface to be embroidered lies between the head and the horizontal arm. The movement of the frame enables to move the item with respect to the members so as to obtain the embroidery.

For embroidering caps or hats having a substantially spherical surface (or at least a surface portion), such as e.g. baseball caps, it is known to use a substantially cylindrical frame, onto which the cap to be embroidered is fastened, with its band proximal to the free edge adhering to the lateral surface of the cylindrical frame, the frame being positioned so as to surround the end of the horizontal arm. In other words, the circular edge of the cap adheres to the cylindrical frame and surrounds the end of the horizontal arm of the machine, whereas the upper portion of the cap, typically shaped as a spherical crown, remains beyond the horizontal arm. This frame can rotate around its middle axis oriented parallel and below the horizontal arm, keeping the outer surface of the aforesaid proximal band of the cap between the needle and the horizontal arm. The combination of the rotary movement of the cylindrical frame with the shifting movement of the frame along its middle axis enables the machine to embroider the outer surface of the aforesaid band of the cap lying near the edge of said cap.

The Applicant has found out that current machine for embroidering caps are not without drawbacks and can be improved under various aspects.

In particular, the Applicant has found that it is impossible or extremely hard to make an embroidery on the whole surface of a cap with known machines, since the surface fraction which can be subjected to the sewing members is limited to an outer band with limited width extending from the free edge of the cap. As a matter of fact the top portion of the cap surface, i.e. the spherical crown far from the cap edges and in the middle of the cap, cannot reach the space where the embroidery stitch is formed between the head and the horizontal arm, e.g. due to the interference of said crown with the aforesaid horizontal arm and/or due to the fact that the bending of the spherical crown, if the cap is moved along the aforesaid middle axis, makes the surface to be embroidered more and more inclined in the space where the embroidery is formed with respect to an optimal horizontal plane.

Another drawback of known machines consists in general in the limited movements of the aforesaid frame, in particular of the cylindrical frame.

Another drawback found by the Applicant consists in that in known machines it is necessary to assemble and disassemble several times the item to be embroidered from the aforesaid frame, for being able to position different portions of the outer band of the item, typically non adjacent to one another, correctly between the head and the horizontal arm. This typically implies longer times and higher costs related to embroidery.

Under these circumstances, the technical task underlying the present invention consists in providing an embroidery machine which is able to obviate one or more of the drawbacks referred to above.

Within this technical task, one of the aims of the present invention in one or more of its various aspects consists in providing an embroidery machine which enables to make an embroidery on an item having at least a spherical surface portion. In particular, the aim is to provide an embroidery machine which is able to embroider every point of this spherical portion.

Another possible aim of the present invention in one or more of its various aspects consists in providing an embroidery machine which is able to increase productivity, reducing times and costs related to embroideries made on items having a spherical surface portion.

Another possible aim of the present invention in one or more of its various aspects consists in providing a machine for embroidering an item characterized by high quality embroideries.

One or more of the aims above, and other possible aims, which will be more readily apparent from the following description, are substantially achieved by a machine for embroidering an item and by the use thereof for embroidering items according to one or more of the appended claims, each of them being considered alone (without its dependent claims) or in any combination with other claims, and according to the following aspects and/or embodiments, variously combined, also together with the aforesaid claims.

In one aspect, the invention relates to a machine for embroidering an item, the machine comprising a frame, an upper head stiffly mounted to said frame and provided with upper embroidering members, and a vertical column having a lower end stiffly fastened to said frame and a free upper end provided with lower embroidering members facing said upper embroidering members, the machine comprising actuating members acting upon said upper and lower embroidering members for forming embroidery stitches in a predefined point of the space between the upper head and the upper end of the vertical column, the machine further comprising a positioning device mounted to said frame and comprising a support, intended to removably house the item in a stable configuration, and movement members for said support with respect to said frame so as to make an embroidery on a surface of the item, wherein the positioning device is structured so that said support can rotate around a first axis, orthogonal to an axis of vertical development of said vertical column, and around a second axis, orthogonal to said first axis and to said axis of vertical development, said second axis intersecting said first axis in a center of rotation vertically aligned with the predefined point in space and lying at a lower level than the latter.

The Applicant thinks that the combination of the aforesaid technical characteristics, in particular the presence of the vertical column and of the positioning device which can rotate the support onto which the item to be embroidered is mounted, with respect to the aforesaid first and second axis, and to orient it with respect to the aforesaid center of rotation, enables to subject to the action of the upper and lower embroidering members the whole surface of a spherical surface portion of an item, in particular a cap. In further detail, as will be evident below, each point of the aforesaid spherical surface portion of the item to be embroidered can be positioned in the aforesaid predefined point in space in which the embroidery stitch is made. The Applicant has pointed out in this respect that the positioning device, thanks to the two rotations around the first and second axis as described above, enables for the first time to move and orient the item in space so as to embroider up to the top of the surface of a cap, i.e. up to the middle of the crown.

In the present description and claims, the word "item" refers to a product, typically a textile product, on which an embroidery has to be made, having a three-dimensional shape and a curved surface or a surface shaped as a spherical portion (e.g. a spherical crown). The item can be by way of example an item of clothing (e.g. a hat, a cap, a headgear), or another product (e.g. a bag, a lining) or a textile semi-finished product intended to be joined to other semi-finished products. In general, the present invention applies to items made of any material, e.g. depending on the various circumstances an item obtained by weaving or knitting, or a non-woven item (e.g. felt), or an item made of leather, rubber, paper or plastic material.

In one aspect, the support is shaped so that, when the item having a spherical outer surface is housed on the support, said center of rotation is at the same distance from the points of the surface of said portion.

In one aspect, the machine comprises a horizontal bar provided with a first end (stiffly) mounted to the frame and with a second end, opposed to said first end, onto which said vertical column is (stiffly) mounted. Thus the assembly bar-vertical column is globally shaped so that the space around the vertical column (included below the latter) is advantageously free from hindrances and can be occupied by the support in its various positions. In particular, the support can surround on several sides the vertical column without creating interferences with the machine frame.

In one aspect, said support is shaped as a ring, preferably circular, to (inside) which the item to be embroidered is mounted, so that a free edge of the item is associated to the ring and the item surface is positioned on the opposite side of the vertical column with respect to the frame, said ring having a through hollow into which the vertical column can be introduced at least partially (typically completely) during the movement of said support.

In one aspect, said positioning device comprises a fixed part stiffly mounted to said frame and a mobile part to which said support is movably mounted, said mobile part being able to rotate with respect to said fixed part around said first axis and said support being able to rotate with respect to said mobile part around said second axis.

In one aspect, the invention relates to a use of the aforesaid embroidery machine according to one or more of the aspects and/or embodiments for making an embroidery on an item having at least a substantially spherical surface portion.

Further characteristics and advantages will be more evident from the detailed description of some exemplary though not exclusive embodiments, among which also a preferred embodiment, of a machine for embroidering an item according to the present invention. This description is disclosed below with reference to the accompanying drawings, provided to a merely indicative and therefore non-limiting purpose, in which.

Figure 1:
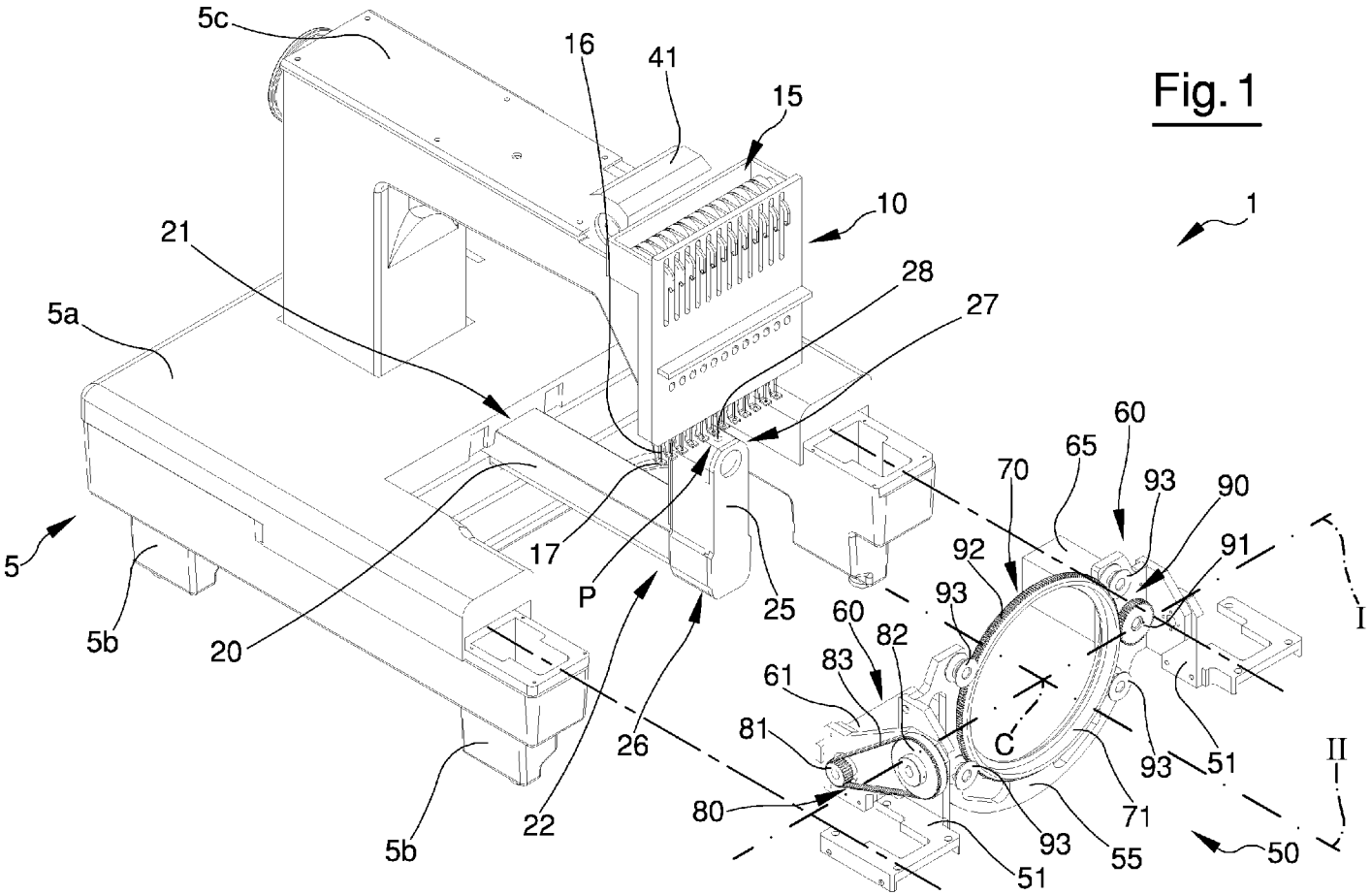
FIG. 1 is a partially exploded, perspective view of the machine for embroidering an item according to the present invention.

With reference to the accompanying figures, a machine for embroidering an item according to the present invention is globally referred to with the numeral 1. In general, the same reference is used for identical or similar elements, if necessary in their execution variants.

The machine 1 is a machine for embroidering an item having a surface shaped as a spherical crown or in general at least a spherical surface portion. The machine comprises a frame 5, an upper head 10 stiffly mounted to the frame and provided with upper embroidering members 15, and a vertical column 25 having a lower end 26 stiffly fastened to the frame and a free upper end 27 provided with lower embroidering members facing the upper embroidering members. The machine 1 comprises actuating members acting upon the upper 15 and lower embroidering members so as to form embroidery stitches in a predefined point of the space P between the upper head 10 and the upper end 27 of the vertical column 25. The machine 1 further comprises a positioning device 50 mounted to the frame 5 and comprising a support 70, intended to removably house the item in a stable configuration, and movement members 60 for the support with respect to the frame so as to make an embroidery on the surface of the item. The positioning device 50 is structured so that said support can rotate around a first axis I orthogonal to an axis of vertical development of the vertical column 25, and around a second axis II orthogonal to the first axis and to the axis of vertical development and intersecting at the same time the first axis in a center of rotation C. This center of rotation is vertically aligned with the aforesaid predefined point in space P and lies at a lower level than the latter.

It should be noted that, in FIG. 1, the first axis I and the center of rotation C, due to the partially exploded view of the figure, lie in a position shifted along the second axis II with respect to the actual position they occupy in the machine.

In one aspect of the present invention, as shown by way of example in FIG. 1, the support 70 is shaped so that, when the item having a spherical outer surface portion is housed thereon, the center of rotation C is at the same distance from the points of the surface of said portion. For instance, in the case of a cap having the shape of a substantially spherical crown, by placing the cap on the support 70, the aforesaid center of rotation C will coincide with the geometrical center of the spherical surface of the cap. In further detail, since the center of rotation is vertically aligned with the predefined point in space P where the embroidery stitch is formed, and since the distance between these two points is fixed and corresponds to the radius of the spherical surface of the cap, every movement of the support in space, around the first I and second axis II as described above, will result in a specific orientation in space of the cap, so that a different area of the cap surface can be embroidered.

Preferably, the frame 5 comprises a horizontal base 5*a* provided with resting feet 5*b*, and an upper arm 5*c* supporting the upper head 10. The frame 5 in its various parts can be made e.g. starting from metal shells, plates or bars, e.g. melted, molded or forged and joined by means of weldings or bolts.

Preferably, as in the exemplary embodiment of the figures, the machine 1 comprises a horizontal bar 20 provided with a first end 21 stiffly mounted to the frame 5 and with a second end 22, opposed to the first end, onto which the vertical column 25 is stiffly mounted. This horizontal bar 20 has a respective axis of horizontal development, preferably orthogonal to the axis of vertical development of the vertical column 25.

Preferably, the upper embroidering members 15 comprise at least one needle 16, carrying a respective thread, and a fabric-pressing foot 17 associated thereto. The aforesaid actuating members make the needle move along a respective vertical axis parallel to, preferably coinciding with, the axis of longitudinal development of the vertical column 25. This movement preferably occurs between an upper position and a lower position in which the needle 16 interacts with the lower embroidering members for making the embroidery stitch.

In one preferred aspect, as shown by way of example in the figures, the upper members 15 comprise a plurality of needles 16, each carrying a respective thread (e.g. of different color or yarn type), and a plurality of fabric-pressing feet 17, each associated to the respective needle. Under these circumstances, the actuating members comprise a selecting member 41 acting upon the upper embroidering members 15 for letting a needle 16 of this plurality of needles work between said upper and lower position and interact with the lower members. Preferably, the selecting member 41 (e.g. a rotary or linear electric motor, or a pneumatic cylinder) horizontally moves the upper head 10 with a shifting motion enabling to align the desired needle so that the respective vertical axis coincides with the aforesaid axis of vertical development of the vertical column 25 and the movement between the upper and lower position is aligned with the aforesaid predefined point in space (P) and center of rotation (C).

It should be noted that in the figures some elements of the machine have been left out, e.g. reels of embroidery thread, in order to make the figures more readily understandable, since they are known in the technical field. These thread reels are of known type and are typically fed into the machine on the upper arm 5*c* at the beginning of the machine operations and/or when the thread is over.

Preferably, the lower embroidering members comprise a crochet (rotary hook) and a bobbin (not shown, e.g. of known type) placed inside the upper end 27 of the vertical column 25, this upper end being provided with a hole 28. Preferably, the hole 28 is coaxial to the axis of vertical development of the vertical column 25. When the aforesaid needle 16 is in lower position, it gets into the upper end through this hole 28 and interacts with the crochet (according to an operating mode known in the technical field of textile embroidery machines) for making an embroidery stitch.

Preferably, the actuating members are structured for moving the needle 16 and the crochet in a synchronized manner, so as to obtain a correct embroidery.

Preferably, the support 70 comprises a ring 71, preferably circular, to (preferably inside) which the item to be embroidered is mounted, so that a free edge of the item is associated to the ring and the item surface is positioned on the opposite side of the vertical column 25 with respect to the frame 5. This ring has a through hollow into which the vertical column 25 can be introduced, partially or completely, during the movement of the support necessary to embroider the desired portions of the item surface. The item to be embroidered is mounted to the support by means of hooking members (not shown, e.g. of known type) such as pliers, jaws or straps typically on the aforesaid free edge of the item.

Figure 2:
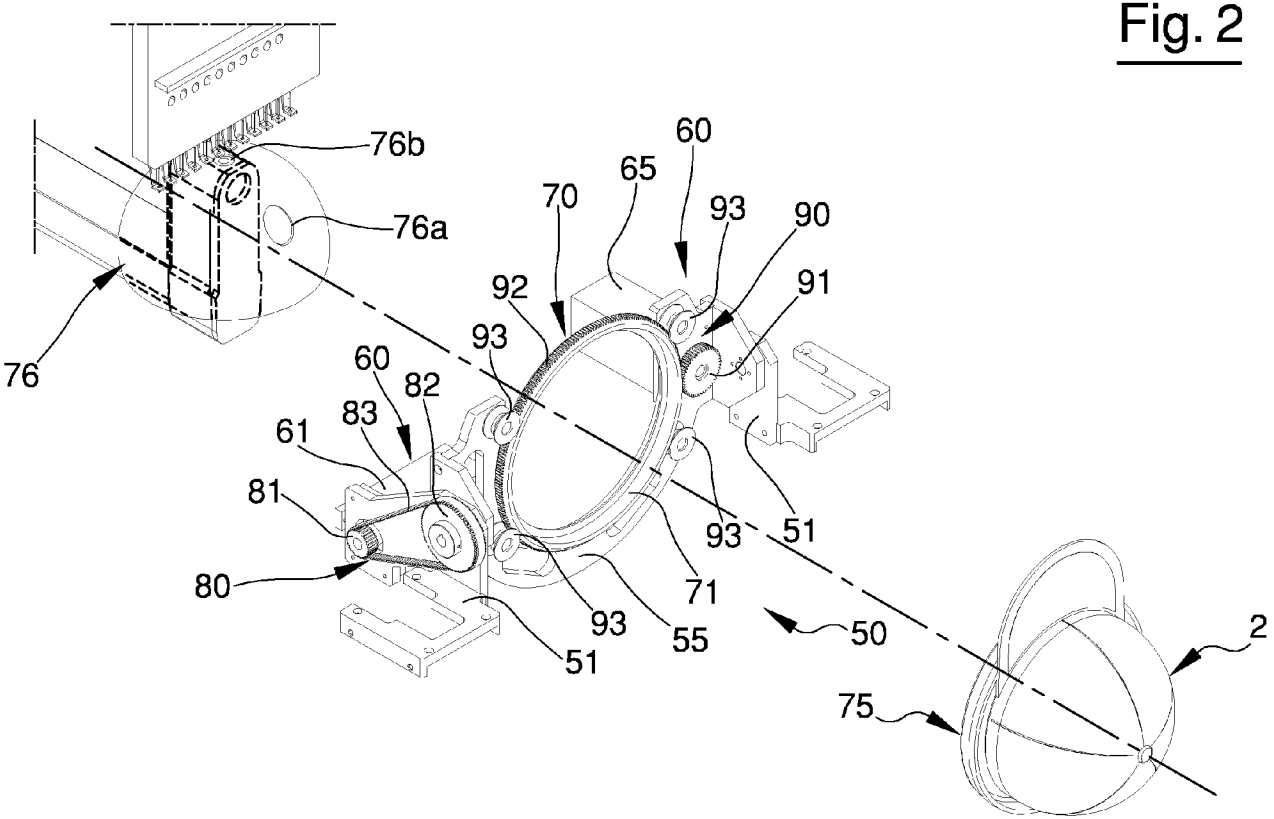
FIG. 2 is a partially exploded, partial perspective view of a possible embodiment of the embroidery machine according to the present invention.

Preferably, the support 70 can comprise one or more supporting elements apt to support the item during the movement of the support and the embroidery operation. By way of example, as shown in FIG. 2, the support comprises a strap 75 which is able to block a free edge of the item onto the ring 71 while the item surface is supported by a fixed supporting element 76 placed around the upper end 27 of the vertical column 25. This fixed supporting element 76 is for instance of hemispherical shape and can be provided with a lateral hole 76*a* for introducing and removing the bobbin into/from the vertical bar, and with an upper hole 76*b* opening onto the hole 28.

Figure 3:
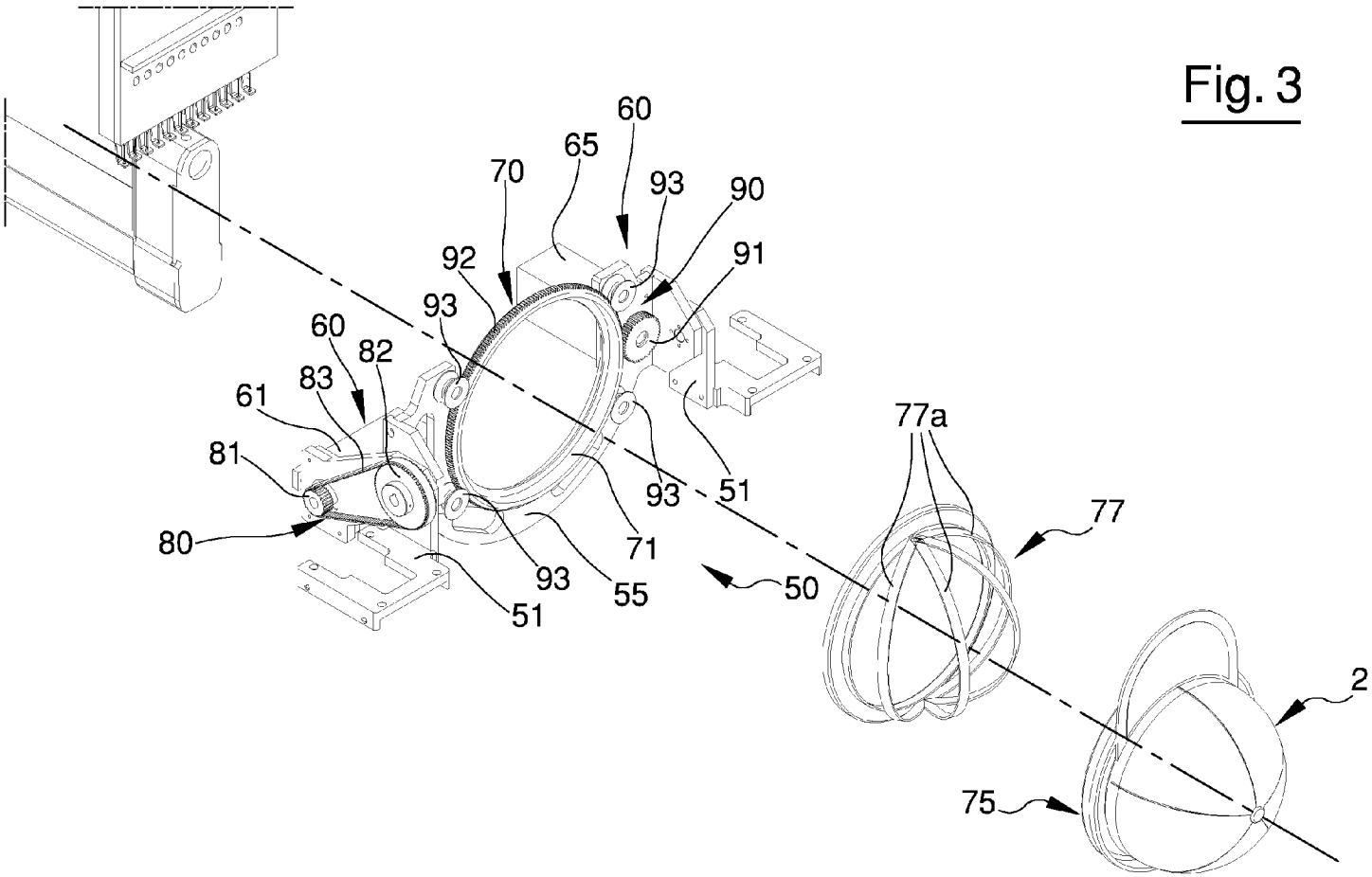
FIG. 3 is a partially exploded, partial perspective view of another possible embodiment of the embroidery machine according to the present invention.

As an alternative, as shown by way of example in FIG. 3, the support can comprise a strap 75 which is able to block a free edge of the item onto the ring 71, and an adjustable supporting element 77 associated to the ring 71 (and moving integrally with the latter) and provided with a plurality of supporting bars 77*a*, preferably of semicircular shape, pivoted in one point and mobile on a semicircular surface. Thus the position of these supporting bars 77*a* can be adjusted so that the surface portion to be embroidered lies between two adjacent bars, so as to let the surface to be embroidered free inside and outside (so that the needle can get through the surface) and support at the same time the item surface as a whole.

As an alternative, the support can comprise a supporting element (not shown, e.g. made of plastic material with suitable through openings) matching the shape of the item to be embroidered.

Preferably, as shown by way of example in the figures, the positioning device 50 comprises a fixed part 51, stiffly mounted to the frame 5, and a mobile part 55 to which the support 70 is movably mounted. Preferably, the mobile part 55 rotates with respect to the fixed part 51 around the aforesaid first axis I and the support 70 rotates with respect to the mobile part 55 around the aforesaid second axis II. By way of example, the fixed part 51 can comprise or consist of two fixed elements placed on opposite sides of the mobile part 55. Preferably, these fixed elements have the same shape as and/or are arranged symmetrically with respect to the second axis.

Preferably, the movement members 60 comprise a first 61 and a second motor 65 configured for making the support 70 rotate around the first I and the second axis II, respectively.

Preferably, the first motor 61 is mounted to the fixed part 51 of the positioning device 50, or alternatively to the frame 5, and makes the mobile part 55 rotate around the first axis I, whereas the second motor 65 is mounted to the mobile part 55 and makes the support 70 rotate around the second axis II with respect to the mobile part 55 of the positioning device 50. Thus the movement caused by the first motor 61 is independent from the movement caused by the second motor 65, and conversely, in other words a rotation of the support around the first axis I does not imply a rotation of the support around the second axis II, and conversely. By way of example, the first and second motor can be of known type, such as a direct current motor, a brushless motor, a stepper motor or an asynchronous motor. In further detail, in this exemplary configuration the first motor 61 moves integrally the mobile part 51 of the positioning device 50, the support 70 and at the same time the second motor 65. The second motor 65, integrally with the mobile part 55, moves the support 70 only with respect to the mobile part.

Preferably, the movement members 60 comprise a further motor (not shown), typically mounted integrally with the frame 5, which enables to shift the support 70 (typically by shifting the whole positioning device) along an axis parallel to, preferably coinciding with, the axis of vertical development of the vertical column 25 or the first axis I or the second axis II. It is thus possible to position in space items having a variously curved surface keeping the desired surface portion to be embroidered in the aforesaid predefined point in space P.

Preferably, as in the exemplary embodiment shown in the figures, the movement members 60 comprise a first mechanical transmission 80 associated to the first motor 61 and able to transmit motion from the first motor to the mobile part 55 of the positioning device 50, and a second mechanical transmission 90 associated to the second motor 65 and able to transmit motion to the support 70.

Preferably, the first mechanical transmission 80 comprises a first and a second pulley 81 and 82, e.g. gear pulleys and/or pulleys with parallel axes, and a drive belt 83, e.g. a tootled belt, mounted onto them, wherein the first pulley 81 is mounted coaxially to the drive shaft of the first motor 61 and the second pulley 82 is coaxial to the first axis and integral with the mobile part 55 of the positioning device 50.

Preferably, the second mechanical transmission 90 comprises a first 91 and a second gear wheel 92 engaged one with the other, e.g. with parallel axes, wherein the first gear wheel 91 is mounted to the drive shaft of the second motor 65 and the second gear wheel 92, e.g. shaped as an externally toothed crown, is integral with the support 70. This second gear wheel 92 has a toothed portion on the lateral, internally and/or externally tangential surface. Preferably, the ring-shaped support 70 consists in the aforesaid second gear wheel 92.

Preferably, the second mechanical transmission 90 can further comprise one or more grooved guide rolls 93, mounted to the mobile part 55 of the positioning device 50, apt to guide the rotational movement of the support 70 with respect to the mobile part, the position and alignment of the aforesaid second axis II around which the support rotates being unchanged during machine operation.

In general, the first 80 and the second mechanical transmission 90 can advantageously be any suitable mechanisms or gears.

Preferably, the machine further comprises an electronic central control unit (not shown, e.g. integrated into or associated to the frame 5) programmed for managing the operation, programming and control of the machine 1 and interfaced with the positioning device 50 (e.g. the movement members 60) and/or with the actuating members so as to correctly move the support 70 and actuate the upper 15 and lower embroidery members for obtaining an embroidery, having a given geometrical pattern, in a given portion of the item surface.

Preferably, the machine can further comprise a user interface (not shown) for entering data into the electronic central control unit (e.g. for selecting or programming a particular embroidery) and/or for displaying information on the status of the machine 1.

Preferably, the machine 1 can further comprise a control device (not shown, e.g. an optical or electronic or proximity or contact sensor), connected to the electronic central control unit, which is able to detect the position and/or the orientation of the item (e.g. with respect to the frame and/or the upper and/or lower embroidery members) and/or to check the obtained embroidery.

Preferably, the machine described in the present invention can further comprise a known framework apt to make a flat embroidery, and known movement members for moving this framework. It is thus possible to increase the versatility of the machine with respect to known machines since it can alternatively make embroideries on items having a spherical surface portion or on items having a flat surface. In this case the positioning device 50 described above can be mounted to the frame so that, by a suitable rotation around the first axis I, the support 70 does not occupy the space containing the aforesaid known framework and the aforesaid known movement members, which can interact with the upper and lower embroidery members described above for making a flat embroidery. It is thus unnecessary to remove the positioning device 50 if a flat embroidery has to be made, and conversely it is unnecessary to mount this device again to switch to the embroidery mode for spherical surfaces, thus reducing times and costs related to operations for machine preparation and adjustment.

If, conversely, an item having a spherical surface portion has to be embroidered, the aforesaid framework remains in a fixed position (or is removed) and the space around the vertical column is free so as to enable the movement of the support on which the item is housed.

The invention claimed is:

1. A machine (1) for embroidering an item, the machine comprising a frame (5), an upper head (10) stiffly mounted to said frame and provided with upper embroidering members (15), and a vertical column (25) having a lower end (26) stiffly fastened to said frame (5) and a free upper end (27) provided with lower embroidering members facing said upper embroidering members (15), the machine (1) comprising actuating members acting upon said upper (15) and lower embroidering members for forming embroidery stitches in a predefined point of the space (P) between the upper head (10) and the upper end (27) of the vertical column (25), the machine (1) further comprising a positioning device (50) mounted to said frame (5) and comprising a support (70), intended to removably house the item in a stable configuration, and movement members (60) for moving said support with respect to said frame so as to make an embroidery on a surface of the item, wherein the positioning device (50) is structured so that said support (70) can rotate around a first axis (I), orthogonal to an axis of vertical development of said vertical column (25), and around a second axis (II), orthogonal to said first axis and to said axis of vertical development, said second axis intersecting said first axis in a center of rotation (C) vertically aligned with the predefined point in space (P) and lying at a lower level than the latter.

2. The machine (1) according to claim 1, wherein the support (70) is shaped so that, when the item having a spherical external surface portion is housed on the support, said center of rotation (C) is at the same distance from the points of the surface of said portion.

3. The machine (1) according to claim 1, comprising a horizontal bar (20) provided with a first end (21) stiffly mounted to said frame (5) and with a second end (22), opposed to said first end, onto which said vertical column (25) is stiffly mounted.

4. The machine (1) according to claim 1, wherein said support (70) is shaped as a ring (71) to which the item to be embroidered is mounted, so that a free edge of the item is associated to the ring and the item surface is positioned on the opposite side of the vertical column (25) with respect to the frame (5), said ring (71) having a through hollow into which the vertical column (25) can be at least partially introduced during the movement of said support (70).

5. The machine (1) according to claim 1, wherein said positioning device (50) comprises a fixed part (51), stiffly mounted to said frame (5), and a mobile part (55), to which said support (70) is movably mounted, said mobile part (55) being able to rotate with respect to said fixed part (51) around said first axis (I) and said support (70) being able to rotate with respect to said mobile part (55) around said second axis (II).

6. The machine (1) according to claim 1, wherein said movement members (60) comprise a first (61) and a second motor (65) configured for making said support (70) rotate around said first (I) and second axis (II), respectively, said first motor (61) being mounted to the fixed part (51) of the positioning device (50), or to the frame (5), and being apt to make said mobile part (55) of the positioning device (50) rotate around said first axis (I), and said second motor (65) being mounted to said mobile part (55) of the positioning device (50) and being apt to make said support (70) rotate around said second axis (II) with respect to said mobile part (55) of the positioning device (50).

7. The machine (1) according to claim 6, wherein said movement members (60) comprise a first mechanical transmission (80) associated to said first motor (61) and able to transmit motion from the first motor to said mobile part (55) of the movement device (50), and a second mechanical transmission (90) associated to said second motor (65) and able to transmit motion to said support (70), said second mechanical transmission (90) comprising a first (91) and a second gear wheel (92) engaged with one another, wherein said first gear wheel (91) is mounted to the drive shaft of said second motor (65) and said second gear wheel (92) coincides with said support (70) shaped as a ring (71) and has a toothed portion on the lateral surface.

8. The machine (1) according to claim 1, wherein said movement members (60) comprise a further motor apt to shift said support (70) along an axis parallel to said axis of vertical development of said vertical column (25) or said first axis (I) or said second axis (II).

9. The machine (1) according to claim 1, further comprising an electronic central control unit programmed for controlling said positioning device (50) and said actuating members so as to correctly move the support (70) and actuate the upper (15) and lower embroidery members for making an embroidery, having a given pattern, in a given portion of the item surface.

10. A method of using a machine (1) for embroidering according to claim 1, comprising using said machine for making an embroidery on an item having at least a substantially spherical surface portion.

* * * * *